US009371798B2

(12) United States Patent
Ozaki et al.

(10) Patent No.: US 9,371,798 B2
(45) Date of Patent: Jun. 21, 2016

(54) FREE-PISTON TYPE STIRLING ENGINE

(75) Inventors: Shou Ozaki, Fujisawa (JP); Yasushi Yamamoto, Chigasaki (JP); Hirotsugu Yabe, Fujisawa (JP)

(73) Assignee: ISUZU MOTORS LIMITED, Tokyo (JP)

( * ) Notice: Subject to any disclaimer, the term of this patent is extended or adjusted under 35 U.S.C. 154(b) by 197 days.

(21) Appl. No.: 14/239,944

(22) PCT Filed: Sep. 13, 2012

(86) PCT No.: PCT/JP2012/073517

§ 371 (c)(1),
(2), (4) Date: Feb. 20, 2014

(87) PCT Pub. No.: WO2013/039170

PCT Pub. Date: Mar. 21, 2013

(65) Prior Publication Data

US 2014/0216026 A1 Aug. 7, 2014

(30) Foreign Application Priority Data

Sep. 16, 2011 (JP) ..... 2011-202490

(51) Int. Cl.
*F02G 1/043* (2006.01)
*F02G 1/053* (2006.01)
*F01B 11/02* (2006.01)

(52) U.S. Cl.
CPC ..... *F02G 1/053* (2013.01); *F01B 11/02* (2013.01); *F02G 1/043* (2013.01); *F02G 1/0435* (2013.01)

(58) Field of Classification Search
CPC ..... F02G 1/0435; F02G 1/053; F01B 11/02
See application file for complete search history.

(56) References Cited

U.S. PATENT DOCUMENTS 5,525,845 A 6/1996 Beale et al.
2011/0056196 A1 3/2011 Berchowitz et al.

FOREIGN PATENT DOCUMENTS

JP 4-263751 A 9/1992
JP 09-510534 A 10/1997

(Continued)

OTHER PUBLICATIONS

International Search Report of PCT/JP2012/073517 dated Nov. 20, 2012.
Extended European Search Report dated Mar. 25, 2015, issued by the European Patent Office in counterpart European application No. 12831278.2.

(Continued)

*Primary Examiner* — Audrey K Bradley
(74) *Attorney, Agent, or Firm* — Sughrue Mion, PLLC

(57) ABSTRACT

A free-piston type stirling engine 1 includes a power piston 30 which partitions the inside of a case 2 into a work space 80 and a bounce space 90, a displacer 40, a communication hole 32 provided in the power piston 30, a displacer rod 41 extending from the displacer 40 and passing through the communication hole 32, a first displacer supporting spring 50 elastically supporting the displacer rod 41 at its proximal end, and a second displacer supporting spring 60 elastically supporting the displacer rod 41 at its distal end. The power piston 30 and the displacer 40 reciprocate along a central axis X of the case 2 with a phase difference therebetween by expansion and compression of a working gas in the work space 80, and bias forces of the first displacer supporting spring 50 and the second displacer supporting spring 60 restrict tilting of the displacer 40 and the displacer rod 41 with respect to the central axis X.

1 Claim, 4 Drawing Sheets

(56) References Cited

FOREIGN PATENT DOCUMENTS

| | | | |
|---|---|---|---|
| JP | 2005-147061 | A | 6/2005 |
| WO | 2006/013377 | A1 | 2/2006 |

OTHER PUBLICATIONS

Chinese Office Action (First Office Action) Dec. 22, 2014, Application No. 201280044829.0.

Communication dated Aug. 26, 2015, issued by CN Intellectual Property Office in corresponding Chinese Application No. 201280044829.0, 4 pages.

FREE-PISTON TYPE STIRLING ENGINE

TECHNICAL FIELD

The present invention relates to a free-piston type stirling engine.

BACKGROUND ART

A free piston stirling engine is described in Japanese Patent No. 3786959.

CITATION LIST

Patent Literature

Patent Literature 1: Japanese Patent No. 3786959

SUMMARY OF INVENTION

Technical Problem

The above-described free piston stirling engine includes a housing having a cylinder, a power piston, and a displacer. The housing is charged with a working gas. The displacer and the power piston are vertically housed within the housing, and a rod portion extending downward from the displacer passes through a hole provided in the center of the power piston. The displacer is elastically supported in a bottom portion of the housing in a reciprocatably cantilevered manner by a supporting spring connected to one end of the rod portion extending through the hole. The housing and an upper surface of the power piston partition a work space in which the displacer reciprocates. A hot end (a heating portion) which heats the working gas in the work space is provided above the housing, and also, a cool end (a cooling portion) which cools the working gas is provided below the housing. In such a configuration, reciprocation of the displacer in the work space causes a temperature change in the working gas in the work space and hence effects reciprocation of the power piston incident to a pressure change in the work space caused by the temperature change.

However, in a case where the above-described free piston stirling engine is installed at an angle other than perpendicular to the ground, the displacer and the rod portion of the displacer may tilt to cause resistance due to excessive friction between the displacer and the housing or between the rod portion of the displacer and an inner peripheral portion of the power piston which partitions the above-described hole, due to the fact that the displacer is supported in a lower portion of the housing in a cantilevered manner by the spring. In this case, the reciprocation of the displacer and the power piston is unstable and hence the reciprocation stops. Therefore, the installed state of the free piston stirling engine is limited to being perpendicular to the ground.

The present invention has been made in view of the above-described circumstances. An object of the present invention is to provide a free-piston type stirling engine which is not limited in its installed state.

Solution to Problem

In order to attain the above object, a free-piston type stirling engine of the present invention includes a case, a power piston, a displacer, a communication hole, a displacer rod, a first elastic supporting member, and a second elastic supporting member.

The case is charged with a working gas. The power piston partitions the inside of the case into a first space and a second space. The displacer is arranged in the first space. The communication hole is provided in the power piston and communicates the first space with the second space along a predetermined axis. The displacer rod extends from the displacer into the second space along the predetermined axis and passes through the communication hole. The first elastic supporting member is arranged in the first space and elastically supports at least one of the displacer and the displacer rod at its proximal end in the case. The second elastic supporting member is arranged in the second space and elastically supports the displacer rod at its distal end in the case.

Also, the communication hole permits movement of the displacer rod with the first space and the second space maintained in their airtight state, and the power piston and the displacer reciprocate respectively along the predetermined axis with a predetermined phase difference therebetween, by means of the working gas in the first space being expanded and compressed by cooling and heating, and bias forces of the first elastic supporting member and the second elastic supporting member restrict tilting of the displacer and the displacer rod with respect to the predetermined axis.

In the above-described configuration, the first elastic supporting member elastically supports at least one of the displacer and the displacer rod, which reciprocate along the predetermined axis with the predetermined phase difference from the power piston when the working gas in the first space is expanded and compressed by cooling and heating, at its proximal end in the case, and also, the second elastic supporting member elastically supports the displacer rod at its distal end in the case, and the bias forces of the first elastic supporting member and the second elastic supporting member restrict the tilting of the displacer and the displacer rod with respect to the predetermined axis. Thus, the displacer and the power piston can reciprocate with stability regardless of the installed state (installed position) of the engine. Thus, the installed state of the engine is not limited.

Also, the first elastic supporting member may be a leaf spring in the shape of a circular plate including an outer peripheral portion fixedly supported in the case, an inner peripheral portion fixedly supporting the displacer rod at its proximal end, and a vent hole which permits passage of the working gas along the predetermined axis.

In the above-described configuration, an increase in dead volume in the first space (the volume of the first space through which little or no working gas passes) due to the arrangement of the first elastic supporting member in the first space can be prevented.

Advantageous Effects of Invention

According to the present invention, a free-piston type stirling engine which is not limited in its installed state can be provided.

DESCRIPTION OF EMBODIMENTS

Figure 1:
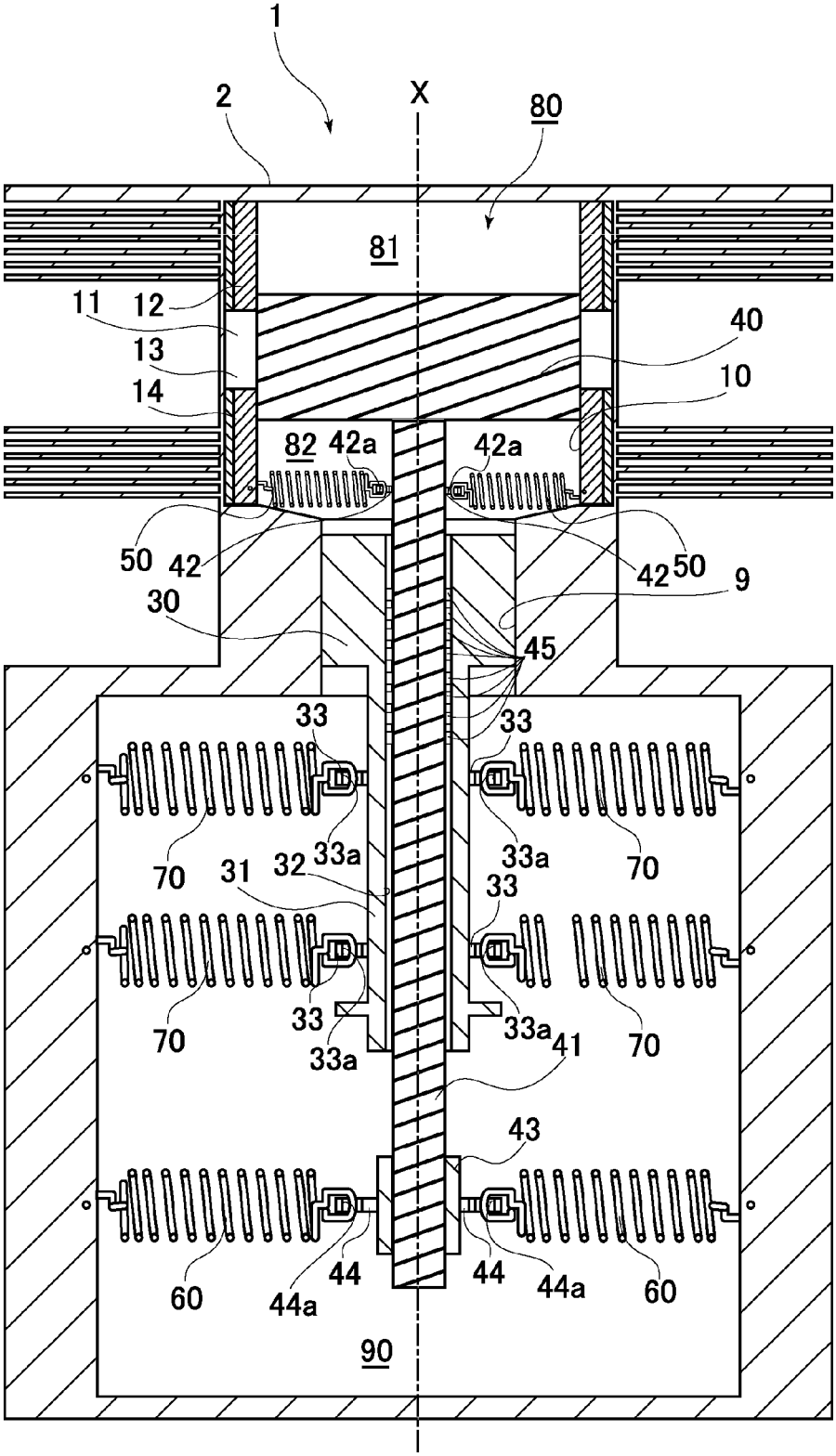
FIG. 1 is a cross-sectional view of a free-piston type stirling engine according to a first embodiment of the present invention.

One embodiment of the present invention will be described in detail below with reference to the drawings. Also, hereinafter, the term "vertical" or "vertically" refers to "vertical" or "vertically" in a case where a free-piston type stirling engine according to the present invention is installed in a state as illustrated in FIG. 1.

A free-piston type stirling engine 1 of the present invention includes a substantially cylindrical case 2, a power piston 30, a displacer 40, a displacer rod 41, a first displacer supporting spring (a first elastic supporting member) 50, a second displacer supporting spring (or a second elastic supporting member) 60, a power piston supporting spring 70, and a controller (unillustrated).

The case 2 is charged with a working fluid, for example, a working gas such as a hydrogen gas, a helium gas or a nitrogen gas. A power piston cylinder 9 which is circular in cross section in a direction orthogonal to a central axis X of the case 2 is installed vertically in a substantially central portion inside the case 2, and a displacer cylinder 10 which is circular in cross section in the above-described direction and has a larger diameter as compared to the power piston cylinder 9 is installed above the power piston cylinder 9. Incidentally, the power piston cylinder 9 and the displacer cylinder 10 having the same diameter may be installed.

The power piston 30 is substantially cylindrical and is installed within the power piston cylinder 9. A power piston rod 31 formed of a rod-shaped body extending downward along a predetermined axis is integrally formed in a substantially central portion of a lower surface of the power piston 30. The power piston rod 31 is formed of the rod-shaped body, and the predetermined axis is the vertically central axis X of the case 2, for example. The power piston 30 and the power piston rod 31 have a communication hole 32 formed through their substantially central portion and extending vertically. Four engagement portions 33 arranged at equally spaced intervals on an outer peripheral surface (for example, at intervals of a length of ¼ of the outer periphery) and extruding circumferentially outward are formed in upper and lower portions, each two, of the power piston rod 31. The engagement portions each have an engagement hole 33*a* formed vertically therethrough in a substantially central portion in a protruding direction, and the other end of the power piston supporting spring 70 as a coil spring fixed at one end to the inside of a sidewall of the case 2 is engaged in the engagement hole 33*a*. The power piston 30 is elastically supported on the case 2 through the power piston rod 31 by the power piston supporting spring 70. Incidentally, the number of the engagement portions 33 installed and the installed places of the engagement portions 33 are not limited to the above but are set according to various conditions such as the mass of the power piston 30.

The power piston 30 elastically supported on the case 2 partitions the inside of the case 2 into a work space (a first space) 80 and a bounce space (a second space) 90. The work space 80 is partitioned by an upper surface of the power piston 30, and is arranged inside the case 2 in its upper portion. The bounce space 90 is partitioned by a lower surface of the power piston 30, and is arranged inside the case 2 in its lower portion. The power piston supporting spring 70 elastically supports the power piston 30 in the bounce space 90, and applies a bias force to the power piston 30 and the power piston rod 31 so as to recover the power piston 30 and the power piston rod 31 to their stopped position, when the power piston 30 and the power piston rod 31 move vertically from their stopped position (or initial position). Also, the power piston supporting spring 70 applies a bias force to the power piston 30 and the power piston rod 31 so as to restrict tilting of the power piston 30 and the power piston rod 31 with respect to the central axis X of the case 2.

A distal end (a lower end) of the power piston rod 31 is connected to a linear motor (unillustrated). When the linear motor is driven, the power piston 30 and the power piston rod 31 reciprocate vertically, and the power piston 30 slides in a power cylinder. The linear motor is driven under control of the controller (unillustrated).

An annular permanent magnet (unillustrated) and pole pieces vertically on both sides of the permanent magnet are arranged in a substantially central portion of the power piston rod 31. The permanent magnet and the pole pieces form a power generation coil (unillustrated) and a linear generator provided in the case 2 and surrounding the permanent magnet. When the power piston 30 and the power piston rod 31 reciprocate vertically, a dielectric electromotive force develops in the power generation coil. The linear generator is connected to a battery (unillustrated), and the battery stores electric power produced by the linear generator and supplies the electric power to various devices connected to the battery, for example, the above-described linear motor and controller.

The displacer 40 is substantially cylindrical and is arranged within the displacer cylinder 10 in the work space 80. The displacer rod 41 formed of a rod-shaped body extending downward along the central axis X of the case 2 and passing through the communication hole 32 of the power piston 30 and the power piston rod 31 is integrally formed in a substantially central portion of a lower surface of the displacer 40. Four proximal-end engagement portions 42 arranged at equally spaced intervals on an outer peripheral surface (at intervals of a length of ¼ of the outer periphery) and extruding circumferentially outward are formed on a proximal end of the displacer rod 41. The proximal-end engagement portions 42 each have an engagement hole 42*a* formed vertically therethrough in a substantially central portion in a protruding direction, and the other end of the first displacer supporting spring 50 as a coil spring arranged in the work space 80 and fixed at one end to the inside of the sidewall of the case 2 is engaged in the engagement hole 42*a*. An annular fitting portion 43 is fitted over a distal end of the displacer rod 41 passing through the communication hole 32 and extending out into the bounce space 90, in such a manner that the annular fitting portion 43 is incapable of relative movement. Four distal-end engagement portions 44 arranged at equally spaced intervals (at intervals of a length of ¼ of the outer periphery) and extruding circumferentially outward are formed on an outer peripheral surface of the fitting portion 43. The distal-end engagement portions 44 each have an engagement hole 44*a* formed vertically therethrough in a substantially central portion in a protruding direction, and the other end of the second displacer supporting spring 60 as a coil spring arranged in the bounce space 90 and fixed at one end to the inside of the sidewall of the case 2 is engaged in the engagement hole 44*a*. The first displacer supporting spring 50 elastically supports the displacer rod 41 at its proximal end in the work space 80, and the second displacer supporting spring 60 elastically supports the displacer rod 41 at its distal end in the bounce space 90, and thereby, the displacer 40 is elastically supported on the case 2 through the displacer rod 41. The first displacer supporting spring 50 and the second displacer supporting spring 60 apply a bias force to the displacer 40 and the displacer rod 41 so as to recover the displacer 40 and the displacer rod 41 to their stopped position, when the displacer 40 and the displacer rod 41 move vertically from their stopped position (or initial position). Also, the first displacer supporting spring 50 and the second displacer supporting spring 60 apply a bias force to the displacer 40 and the displacer rod 41 so as to restrict tilting of the displacer 40 and the displacer rod 41 with respect to the central axis X of the case 2. Incidentally, the numbers of the proximal-end engagement portions 42 and the distal-end engagement portions 44 installed and the installed places of the proximal-end engagement portions 42 and the distal-end engagement portions 44 are not limited to the above but are set according to various conditions such as the mass of the displacer 40. Also, as described later, spring constants of the first displacer supporting spring 50, the second displacer supporting spring 60 and the power piston supporting spring 70 are set so that the power piston 30 and the power piston rod 31 and the displacer 40 and the displacer rod 41 reciprocate with a predetermined phase difference, for example, with a phase difference of 90 degrees, and so that the tilting of the power piston 30 and the power piston rod 31 and the displacer 40 and the displacer rod 41 with respect to the central axis X of the case 2 can be restricted.

Plural annular sealing members 45 made of elastic members, for example, rubber, are provided in a substantially central portion of the displacer rod 41. The sealing members 45 are in intimate contact with inner peripheral surfaces of the power piston 30 and the power piston rod 31 which partition the communication hole 32, and also, as described later, when the displacer rod 41 slides, the sealing members 45 slides on the inner peripheral surfaces thereby to tightly close the work space 80 and the bounce space 90 and prevent the working gas from flowing out and in between the work space 80 and the bounce space 90.

The displacer 40 partitions the work space 80 into an expansion space 81 and a contraction space 82. The expansion space 81 is partitioned by an upper surface of the displacer 40 and is arranged above the displacer 40, or equivalently, in an upper portion of the work space 80. The contraction space 82 is partitioned by a lower surface of the displacer 40 and is arranged below the displacer 40, or equivalently, in a lower portion of the work space 80.

A flow path 11 which provides communication between the expansion space 81 and the contraction space 82 is formed in the displacer cylinder 10. The flow path 11 is provided with a heater portion 12, a regeneration portion 13, and a cooler portion 14. The heater portion 12 is arranged in the vicinity of the expansion space 81 and heats the working gas in the expansion space 81. The cooler portion 14 is arranged in the vicinity of the contraction space 82 and cools the working gas in the contraction space 82. The regeneration portion 13 is arranged between the heater portion 12 and the cooler portion 14. A heat storage material (unillustrated) is provided in the regenerator portion. The heat storage material is formed of a stack of plural wire-meshed members obtained by knitting a metal wire material, such for example as a stainless alloy, having a space which communicates with the inside, being capable of passage of the working fluid therethrough, and having heat storage characteristics. Incidentally, the heat storage material may be a resin matrix obtained by knitting a fiber made of resin such as nylon, or a matrix obtained by knitting a carbon fiber, a ceramic fiber, a steel wool, or the like. While passing through the heat storage material, the working gas flows through the regenerator portion from the top to the bottom or from the bottom to the top, and thereby, the heat storage material performs heat exchange with the working gas to store heat.

Also, the displacer cylinder 10 is provided with a displacer sensor for detecting the displacer 40, and a temperature sensor. The displacer sensor is disposed above the displacer 40 and detects the displacer 40 which has traveled a predetermined distance above its stopped position. When the displacer 40 is detected, the displacer sensor outputs a detection signal. The temperature sensor detects the temperature of the working gas in the work space 80 at intervals of a predetermined time. The temperature sensor outputs temperature information indicating the detected temperature.

The controller is formed of a microcomputer and includes a central processing unit (CPU) which executes operations in accordance with a control program, a read only memory (ROM) which stores the control program and the like, and a readable/writable random access memory (RAM) which stores operated results and the like. The controller controls drive of the linear motor and operation of the heater portion 12 and the cooler portion 14. The controller is connected to the displacer sensor and the temperature sensor and receives the detection signal outputted by the displacer sensor and the temperature information outputted by the temperature sensor.

Next, description will be given with regard to operation of the free-piston type stirling engine of the embodiment.

At the time of start of the engine, the controller controls the heater portion 12 so that the heater portion 12 heats the working gas in the expansion space 81. Then, a decision is made as to whether the temperature of the working gas in the expansion space 81 reaches a predetermined temperature, based on the temperature information received from the temperature sensor at intervals of the predetermined time, and, when the predetermined temperature is reached, the drive of the linear motor is started, and also, the cooler portion 14 is controlled to start cooling the working gas in the contraction space 82. Incidentally, the heating of the working gas in the expansion space 81 by the heater portion 12 is continued.

When the linear motor is driven and thereby the power piston 30 and the power piston rod 31 start reciprocating vertically along the central axis X of the case 2, a pressure change occurs in the work space 80, and the displacer 40 and the displacer rod 41 start reciprocating vertically along the central axis X of the case 2. Specifically, when the power piston 30 and the power piston rod 31 move upward, the pressure in the work space 80 increases, and the displacer 40 and the displacer rod 41 move downward. On the contrary, when the power piston 30 and the power piston rod 31 move downward, the amount of pressure in the work space 80 decreases, and the displacer 40 and the displacer rod 41 move upward.

When the displacer 40 and the displacer rod 41 reciprocate, the volumes of the expansion space 81 and the contraction space 82 change. When the volume of the expansion space 81 decreases and the volume of the contraction space 82 increases, the working gas moves from the expansion space 81 to the contraction space 82 via the flow path 11. On the contrary, when the volume of the expansion space 81 increases and the volume of the contraction space 82 decreases, the working gas moves from the contraction space 82 to the expansion space 81 via the flow path 11. In other words, the volumes of the expansion space 81 and the contraction space 82 periodically increase and decrease incident to the reciprocation of the displacer 40 and the displacer rod 41.

In the contraction space 82 whose volume is increased by a decrease in the volume of the expansion space 81, when the working gas is cooled by the cooler portion 14, the cooled working gas contracts and thus the pressure in the work space 80 decreases. On the contrary, in the expansion space 81 whose volume is increased by a decrease in the volume of the contraction space 82, when the working gas is heated by the heater portion 12, the heated working gas expands and thus the pressure in the work space 80 increases.

By pressure variation in the work space 80, the power piston 30 and the power piston rod 31 are vibrated so as to increase the amount of reciprocation.

When the reciprocation of the displacer 40 and the displacer rod 41 is repeated, the amount of working gas flowing through the flow path 11 and the distance of vertical travel of the displacer 40 in the reciprocation of the displacer 40 increase. Also, the amount of pressure variation of the working gas increases with the increasing amount and distance, and the amount of vibration of the power piston 30 and the power piston rod 31 by the pressure variation also increases.

The displacer sensor detects the displacer 40 with the distance of its vertical travel increased, and outputs a detection signal. Upon receipt of the detection signal, the controller stops the drive of the linear motor. After the stop of the drive of the linear motor, the power piston 30 and the power piston rod 31 and the displacer 40 and the displacer rod 41 continue reciprocating with the predetermined phase difference, by the pressure variation of the working gas in the work space 80 and the bias forces of each of the supporting springs 50, 60, 70.

When the power piston 30 and the power piston rod 31 reciprocate, a dielectric electromotive force develops in the power generation coil of the above-described linear generator, and the battery connected to the linear generator stores electric power produced by the linear generator and supplies the electric power to various devices connected to the battery.

In the above-described configuration, the displacer 40 is elastically supported in the case 2 in a both-end supported manner by the first displacer supporting spring 50 elastically supporting the displacer rod 41 at its proximal end, and the second displacer supporting spring 60 elastically supporting the displacer rod 41 at its distal end. Thus, in a case where the free-piston type stirling engine is installed in a position inclined with respect to the central axis X of the case 2, for example even in a case where the free-piston type stirling engine is installed parallel to the ground, the tilting with respect to the central axis X of the case 2 is restricted, and thus, the displacer 40 and the displacer rod 41 can reciprocate with stability.

Figure 2:
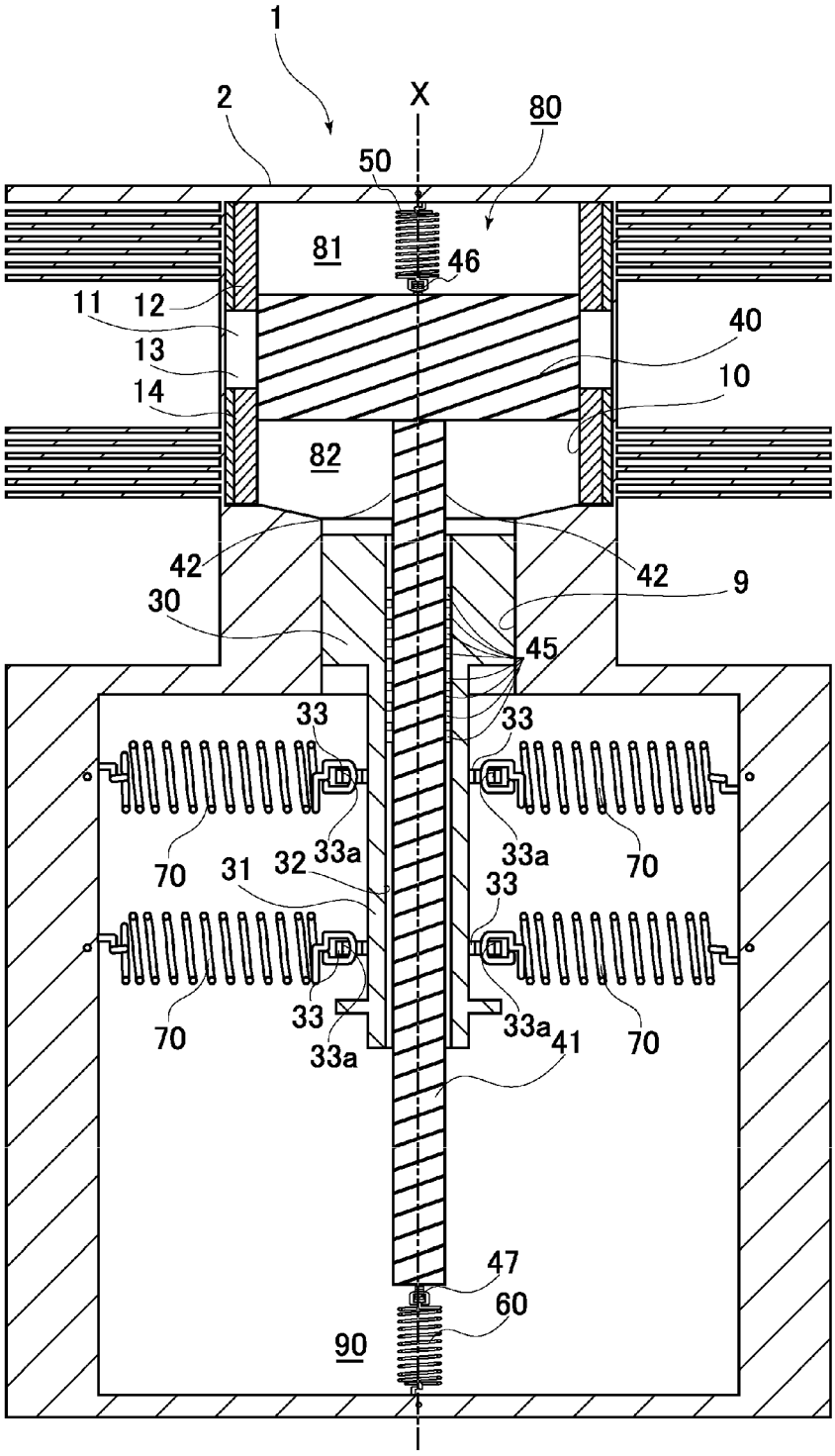
FIG. 2 is a cross-sectional view of a free-piston type stirling engine according to a modification of the first embodiment of the present invention.

In the embodiment, the displacer 40 is described as being elastically supported in the case 2 through the displacer rod 41 by the first displacer supporting spring 50 and the second displacer supporting spring 60 elastically supporting the displacer rod 41 at its proximal and distal ends; however, the displacer 40 may be supported in the following manner. Specifically, as illustrated in FIG. 2, an upper engagement portion 46 provided on the upper surface of the displacer 40 and protruding upward, and a lower engagement portion 47 protruding downward from a distal end portion (a lower end portion) of the displacer rod 41 are provided, and the displacer 40 is elastically supported in the case 2 by the first displacer supporting spring 50 arranged in the work space 80, fixed at one end to the upper portion of the case 2 and engaged at the other end with the upper engagement portion 46, and the second displacer supporting spring 60 arranged in the bounce space 90, fixed at one end to the bottom portion of the case 2 and engaged at the other end with the lower engagement portion 47 of the displacer rod 41.

Figure 3:
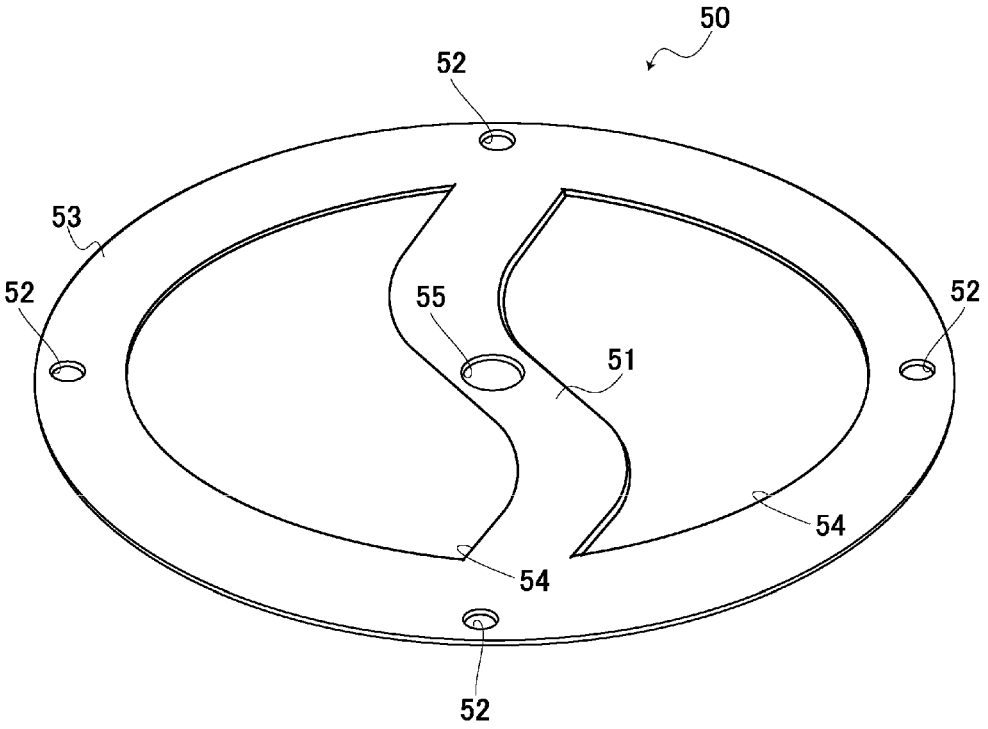
FIG. 3 is a perspective view of a first displacer supporting spring according to a second embodiment of the present invention.

Next, a second embodiment will be described with reference to FIGS. 3 and 4. The second embodiment is different from the first embodiment in that the power piston supporting spring 70, the first displacer supporting spring 50 and the second displacer supporting spring 60 are formed of leaf springs as illustrated in FIG. 3. Hereinafter, in the second embodiment, description of portions common to the first and second embodiments will be omitted.

In the second embodiment, the power piston supporting spring 70, the first displacer supporting spring 50 and the second displacer supporting spring 60 are all formed of circular leaf springs, and are in the same form although their diameters vary according to their installed places. The form of the supporting spring will be described below, taking the first displacer supporting spring 50 as an example.

As illustrated in FIG. 3, the first displacer supporting spring 50 has a supporting hole 55 vertically formed therethrough in the center, and includes an inner peripheral portion 51 curvedly formed, an outer peripheral portion 53 having plural bolt holes 52 formed therein, through which bolts engaged in bolt holes (unillustrated) formed in the case 2 are inserted, and two vent holes 54 formed on both sides with the inner peripheral portion 51 in between and vertically formed through the first displacer supporting spring 50.

Figure 4:
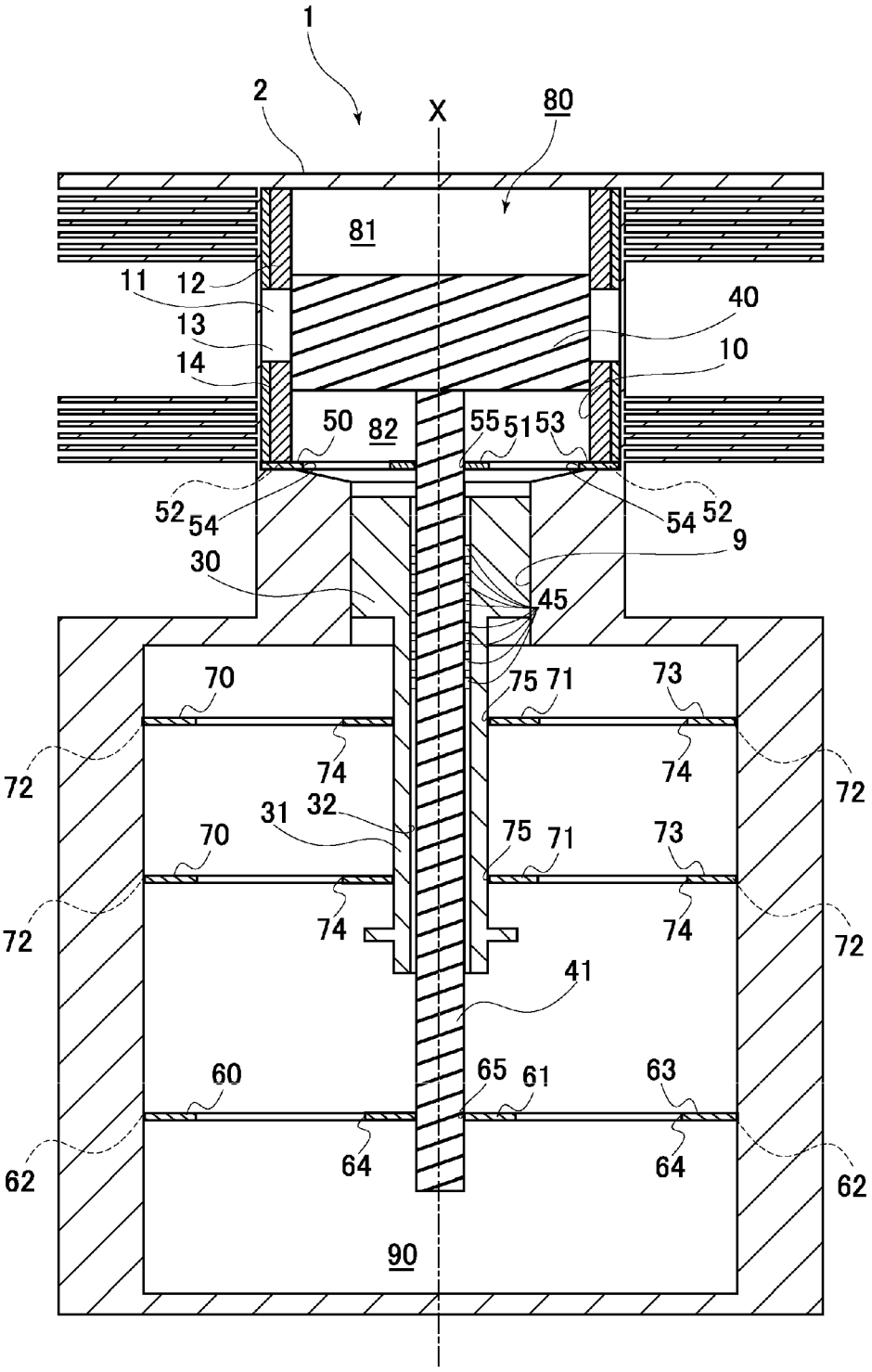
FIG. 4 is a cross-sectional view of a free-piston type stirling engine according to the second embodiment of the present invention.

As illustrated in FIG. 4, when the bolts are inserted through the bolt holes 52 formed in the outer peripheral portion 53 thereby to fix the first displacer supporting spring 50 to the case 2 and arrange the first displacer supporting spring 50 in the work space 80, the displacer rod 41 is inserted through the supporting hole 55 of the inner peripheral portion 51, and the inner peripheral portion 51 elastically supports the displacer 40 at its proximal end in such a manner that the displacer 40 is incapable of relative movement. The vent holes 54 permit the passage of the working gas in the work space 80. Incidentally, the following configuration may be adopted; specifically, the displacer cylinder 10 is provided with bolt holes (unillustrated), and the bolts inserted through the bolt holes 52 formed in the outer peripheral portion 53 are engaged in the bolt holes, and thereby, the first displacer supporting spring 50 is fixed to the displacer cylinder 10.

The second displacer supporting spring 60 is arranged in the bounce space 90, and is in the same form as the first displacer supporting spring 50 as mentioned above and is formed with a larger diameter as compared to the first displacer supporting spring 50. The displacer rod 41 is inserted through a supporting hole 65 of an inner peripheral portion 61 of the second displacer supporting spring 60, and the inner peripheral portion 61 fixes and elastically supports the displacer rod 41 at its distal end in such a manner that the displacer rod 41 is incapable of relative movement. The displacer 40 is elastically supported in the case 2 through the displacer rod 41 by the first displacer supporting spring 50 arranged in the work space 80 and the second displacer supporting spring 60 arranged in the bounce space 90.

The power piston supporting spring 70 is in the same form as the first displacer supporting spring 50 as mentioned above and is formed with substantially the same diameter as the second displacer supporting spring 60. The power piston rod 31 is inserted through a supporting hole 75 of an inner peripheral portion 71 of the power piston supporting spring 70, and the inner peripheral portion 71 fixes and elastically supports the power piston rod 31 in such a manner that the power piston rod 31 is incapable of relative movement. Incidentally, the power piston supporting spring 70 and the second displacer supporting spring 60 are provided on an inner wall of the case 2, and bolts (unillustrated) inserted through bolt holes 72, 62 of outer peripheral portions 73, 63 are engaged in bolt holes (unillustrated) of a bracket (unillustrated) protruding inward of the case 2, and thereby the power piston supporting spring 70 and the second displacer supporting spring 60 are fixed to the case 2. Incidentally, in the second embodiment, the engagement portions 33, the proximal-end engagement portions 42 and the distal-end engagement portions 44 of the first embodiment are not provided on outer peripheral surfaces of the power piston rod and the displacer rod 41.

In the second embodiment, the first displacer supporting spring 50 as the leaf spring arranged in the work space 80 fixedly supports the displacer rod 41 at its proximal end in such a manner that the displacer rod 41 is incapable of relative movement, and thus, an increase in dead volume in the work space 80 due to the provision of the first displacer supporting spring 50 can be prevented as compared to a case where the coil spring is used as the first displacer supporting spring 50.

Although description has been given above with regard to the embodiments to which the invention made by the inventor is applied, the present invention is not limited to discussions and the drawings which form part of the disclosure of the invention by the embodiments.

For example, in the second embodiment, a stack of plural leaf springs may be used as each of the supporting springs 50, 60, 70.

Also, a coil spring and a leaf spring may be used in combination. For example, a leaf spring may be used as the first displacer supporting spring 50, and coil springs may be used as the other supporting springs 60, 70.

Also, in the second embodiment, the vent holes of each of the supporting springs 50, 60, 70 may be formed in a spiral fashion around the supporting holes 55, 65, 75.

In other words, of course, it will be additionally understood that other embodiments, examples and operational technologies and the like made on the basis of the embodiments by those skilled in the art or the like may all be included in the scope of the present invention.

INDUSTRIAL APPLICABILITY

The present invention is widely applicable to a free-piston type stirling engine.

REFERENCE SIGNS LIST

1 piston type stirling engine
2 case
9 power piston cylinder
10 displacer cylinder
11 flow path
12 heater portion
13 regeneration portion
14 cooler portion
30 power piston
31 power piston rod
32 communication hole
33 engagement portion
33*a* engagement hole
40 displacer
41 displacer rod
42 proximal-end engagement portion
43 fitting portion
44 distal-end engagement portion
45 sealing member
50 first displacer supporting spring (first elastic supporting member)
60 second displacer supporting spring (second elastic supporting member)
70 power piston supporting spring
80 work space (first space)
81 expansion space
82 contraction space
90 bounce space (second space)

The invention claimed is:

1. A free-piston stirling engine comprising:

a case charged with a working gas;

a power piston which partitions an inside of the case into a first space and a second space;

a displacer arranged in the first space;

a communication hole provided in the power piston, which communicates the first space with the second space along a predetermined axis;

a displacer rod, which has a proximate end proximate to the displacer and a distal end distal from the displacer, and extends from the displacer into the second space along the predetermined axis through the communication hole;

a first elastic supporting member, which is arranged in the first space, and configured to elastically support the displacer or the displacer rod at the proximal end, in the case; and a second elastic supporting member, which is arranged in the second space, and configured to elastically support the displacer rod at the distal end, in the case, wherein the communication hole permits movement of the displacer rod with the first space and the second space maintained in an airtight state, the power piston and the displacer reciprocate along the predetermined axis with a predetermined phase difference therebetween, by the working gas in the first space being expanded and compressed by cooling and heating, bias forces of the first elastic supporting member and the second elastic supporting member restrict tilting of the displacer and the displacer rod with respect to the predetermined axis, and the first elastic supporting member is a coil spring.

* * * * *